United States Patent [19]

Mogaki et al.

[11] Patent Number: 4,583,255

[45] Date of Patent: Apr. 22, 1986

[54] MASSAGE ARRANGEMENT OF THE PNEUMATIC TYPE

[75] Inventors: Tadahisa Mogaki; Mitsuma Matsumura; Nobuyuki Nozawa; Katsuji Kikuchi; Haruki Nakao; Toshio Mikiya, all of Tokyo, Japan

[73] Assignee: Nitto Kohki Co., Ltd., Tokyo, Japan

[21] Appl. No.: 586,136

[22] Filed: Mar. 5, 1984

[30] Foreign Application Priority Data

Mar. 5, 1983 [JP] Japan ..... 58-36163

[51] Int. Cl.[4] ..... A47C 27/08; A47C 27/10; A61H 1/00

[52] U.S. Cl. ..... 5/453; 5/455; 5/415; 128/33

[58] Field of Search ..... 5/419, 446, 449, 453–457; 128/33

[56] References Cited

U.S. PATENT DOCUMENTS

| | | | |
|---|---|---|---|
| 1,925,358 | 9/1933 | Wittcoff | 5/419 |
| 2,719,986 | 10/1955 | Rand | 128/33 |
| 2,731,652 | 1/1956 | Bishop | 5/455 |
| 2,998,817 | 9/1961 | Armstrong | 128/33 |
| 3,462,778 | 8/1969 | Whitney | 128/33 |
| 3,613,671 | 10/1971 | Poor | 128/33 |
| 4,193,149 | 3/1980 | Welch | 5/453 |
| 4,405,129 | 9/1983 | Stuckey | 5/449 |

FOREIGN PATENT DOCUMENTS

| | | | |
|---|---|---|---|
| 418372 | 10/1934 | United Kingdom | 5/419 |

*Primary Examiner*—Kenneth J. Dorner
*Assistant Examiner*—Michael F. Trettel
*Attorney, Agent, or Firm*—Birch, Stewart, Kolasch & Birch

[57] ABSTRACT

This disclosure relates to a massage arrangement of the pneumatic type comprising a mat body provided with a plurality of juxtaposed air chambers, said mat body being subjected over the entire or local surface to repeated rhythmic wave motions involving expansion and contraction by repeating a successon of feeding and discharging of compressed air into and from said air chambers, whereby effective and stable massage is applied not only to the waist and back regions but also the neck and shoulder regions.

4 Claims, 19 Drawing Figures

MASSAGE ARRANGEMENT OF THE PNEUMATIC TYPE

BACKGROUND OF THE INVENTION

So far, a number of inventions and devices have been proposed for massage equipment designed to provide repeated stimuli by vibration or pressure for the treatment of paralysis, inflammation, etc. of muscles and tendons or for the maintenance or promotion of health. For instance, the present inventors have proposed the mat type pneumatic massage arrangement (U.S. patent application Ser. No. 450,388), which comprises a mat body including a plurality of juxtaposed air chambers which are expanded and contracted in given sequence by successively feeding and discharging compressed air into and from said chambers. Repeated feeding and discharging of compressed air cause rhytmic expansion and contraction of the mat body over the entire surface, thus subjecting the entire mat body to a wave motion which in turn applies massage to the substantially whole body of an individual lying on his or her back or face on the mat body. Such a massage arrangement can give effective massage to an individual without putting any strain thereupon, and can be handled in safety since an air pressure is used as the massage source.

However, there is still left much to be desired for that arrangement. For example, a problem in that the flatness of the mat body prevents the massage effect produced by expansion and contraction thereof from acting upon the shoulder and head regions. It is desired not only to apply massage to the whole body, but also to concentrate local massage to only a desired region.

SUMMARY OF THE INVENTION

The present invention has for its main object to provide a solution to the problem of the prior art massage arrangement of the pneumatic type, and meet all the requirements to be desired.

DETAILED EXPLANATION OF THE PREFERRED EMBODIMENT OF THE INVENTION

Figure 1:
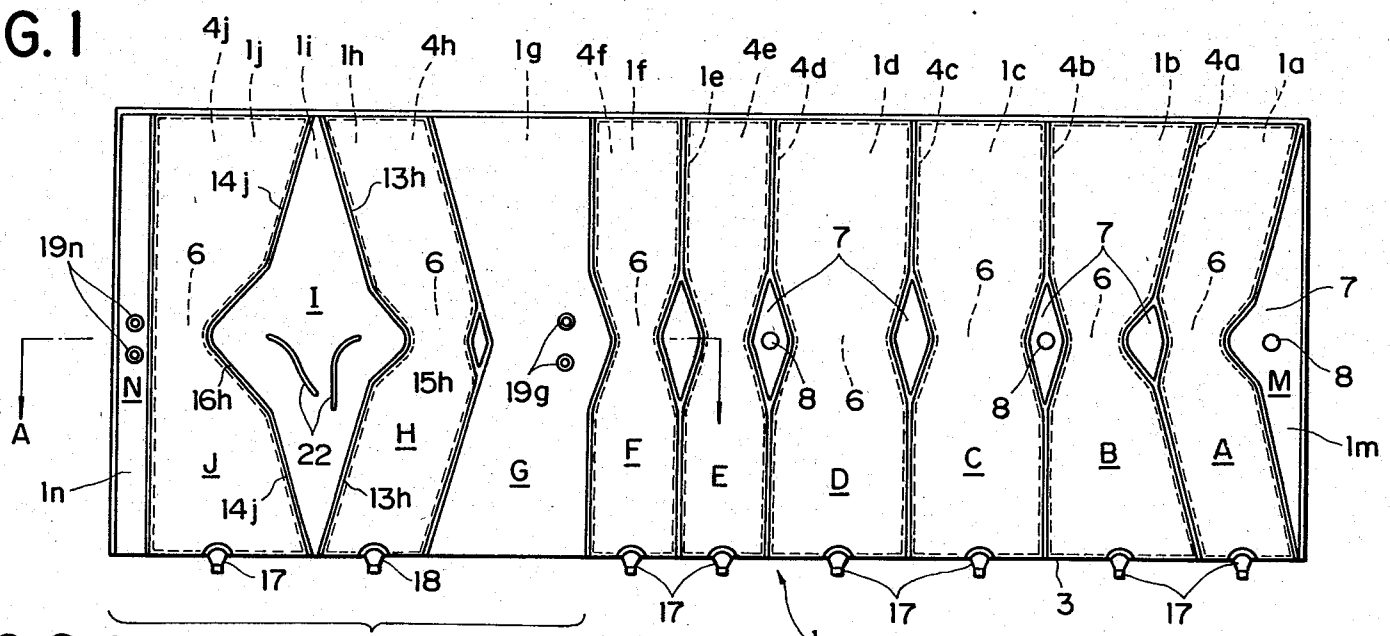
FIG. 1 is a plan view of the mat body according to the present invention.
Figure 3A:
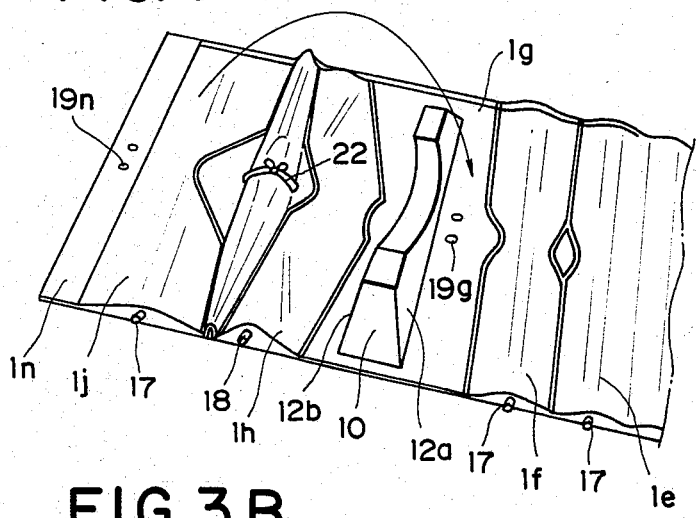
FIG. 3A is a perspective view showing the headrest member placed on the zones not filled with air.
Figure 3B:
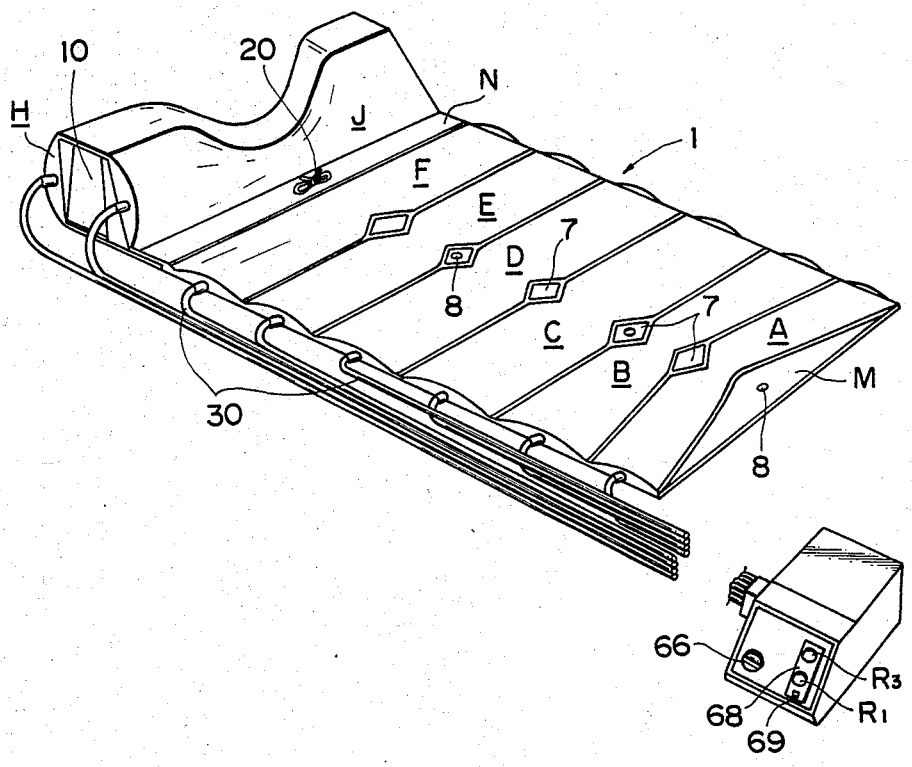
FIG. 3B is a perspective view showing the headrest member enclosed completely within the end of the mat body.

FIG. 1 is a plan view showing the mat body according to the present invention in an extended state, and FIG. 3B is a perspective view showing, together with a compressed air source, the mat when in use.

Figure 2A:
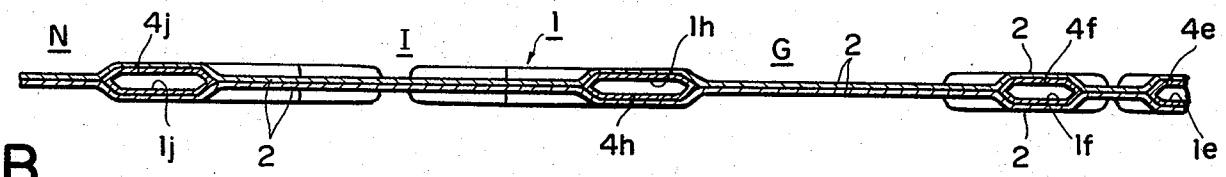
FIG. 2A is a longitudinally sectioned view taken along the line A—A of FIG. 1.
Figure 2B:
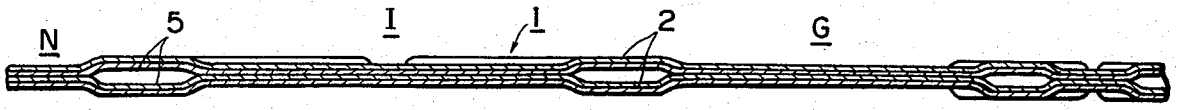
FIG. 2B is a sectional view similar to FIG. 2A, showing another mat body according to the present invention.

A mat body for pneumatic massage, shown at 1, is generally of a rectangular shape, and includes a plurality of air chambers A, B, C, D, E, F, H and J arranged side by side, which are formed in the manner to be described later. The mat body 1 has outer skins 2 and 2 formed of a material which has flexibility but less extensibility. The outer skins 2 and 2 are sealed on three sides except one long side 3, and are longitudinally partitioned into ten (10) chambers, as illustrated in FIG. 1. Of the thus partitioned chambers 1*a*–1*j* as well as 1*m* and 1*n*, the chambers 1*a*–1*f*, *ih* and 1*j* separately receive therein air-tight air bags 4*a*–4*f*, 4*h* and 4*j* to define the air chambers A–F, H and J at three positions of the mat body 1. It is to be noted that the air bags 4*a*–4*f*, 4*h* and 4*j* are made somewhat larger in size than the chambers 1*a*–1*f*, 1*h* and 1*j*, so that unlimited expansion of the said air bags are avoided by the outer skins 2 and 2 so as not to expand them beyond the critical value, whereby bursting of the said bags is avoided. Referring to FIG. 2B, there is another embodiment wherein the air bags 4*a*–4*j* are not arranged in an independent manner. That is, two extensible air-tight sheets 5 and 5 are interposed between the outer skins 2 and 2, and they are fused and joined together, as shown in FIG. 1.

The thus arranged mat body 1 is constricted at the axially central portion of the chambers 1*a*–1*f*, 1*h* and 1*j* to define constricted portions 6, 6 --- . The degree of expansion of these constricted portions 6, 6 --- is smaller than that of most of the remainder. Spaces 7 are formed in consequence of the formation of the constricted portions 6, 6 --- in the chambers. Some spaces 7 are provided therein with eyelets 8.

Of the chambers, the chamber 1g defines a zone G in which no air is filled, and on which a headrest member 10 is placed in the manner to be described later. A portion 9 for giving massage to the shoulder, neck and occipital regions is designed to surround the rear and upper faces of the headrest member 10 (hereinafter referred to as the shoulder massage portion). The air chambers H and J are engaged with the back and front sides 12*b* and 12*a* of the headrest member 10 placed on the zone G, and a zone I between the chambers H and J, in which no air is filled, is tied at the central portion of the headrest member 10 by means of a strap 22 to be in agreement with the concave surface 11 of the central portion of the headrest member 10.

Figure 4A:
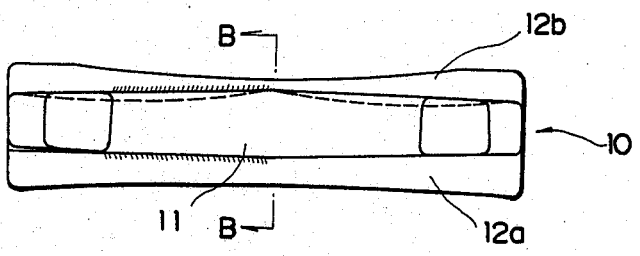
FIG. 4A is a plan view of the headrest member.
Figure 4B:
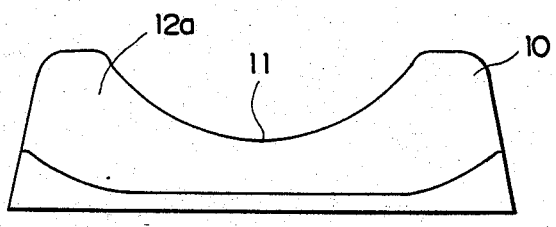
FIG. 4B is a front view of that member.
Figure 4C:
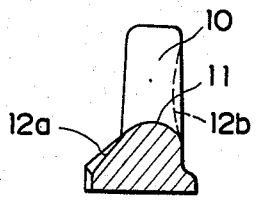
FIG. 4C is a longitudinally sectioned view taken along the line B—B of FIG. 4A.

The headrest member 10 is formed of a foamed material having suitable elasticity such as styrene foam resin. As will be apparent from FIGS. 4A, B and C, the headrest member 10 is of a rectangular configuration having a length equal to the width of the mat body 1. As will be understood from FIG. 4B, the headrest member 10 includes a concave surface 11 on which the neck and occipital regions are to be placed. As will also be noted from FIG. 4C, the front side 12*a* of the headrest member 10 includes a concave surface suitable for the air chamber J to apply pressure to the shoulder region, whilst the back side 12*b* thereof includes a concave surface for the air chamber H to apply forward pressure to the headrest member 10.

Referring again to FIG. 1, the opposing sides of the chambers 1*h* and 1*j* include generally symmetrical slopes 13*h* and 14*j* and curves 15*h* and 16*h* which are configured to the upper concave surface 11 of the headrest member 10. It is to be noted that the reason why the zone I is constricted by tying with the strap 22 is to prevent slackening of the zone I, when it comes into contact with the upper surface of the headrest member 10.

Air feed/discharge ports 17 are provided in one side ends of the air bags 4*a*–4*f* and 4*j*, and an air feed port 18 is formed in one side end of the air bag 4*h*. The air feed port 18 includes a resilient check valve (not shown) which is designed to open when air is pumped into said port, or when the base of said port is pressed down. An eyelet 19*g* is drilled in the central portion of the zone G of the mat body 1, whilst an eyelet 19*n* is formed in the central portion of a zone N in which no air is filled, said zone defining the outermost end of the shoulder massage portion 9 of the mat body 1. When the shoulder massage portion 9 is wound around the headrest member 10, the eyelets 19*g* and 19*n* are designed to overlap each other. The strap 20 is inserted through the eyelets 19*g* and 19*n*, and is tied together, whereby the end N of the shoulder massage portion 9 is joined onto the zone G corresponding to the headrest member of the mat body.

Figure 5A:
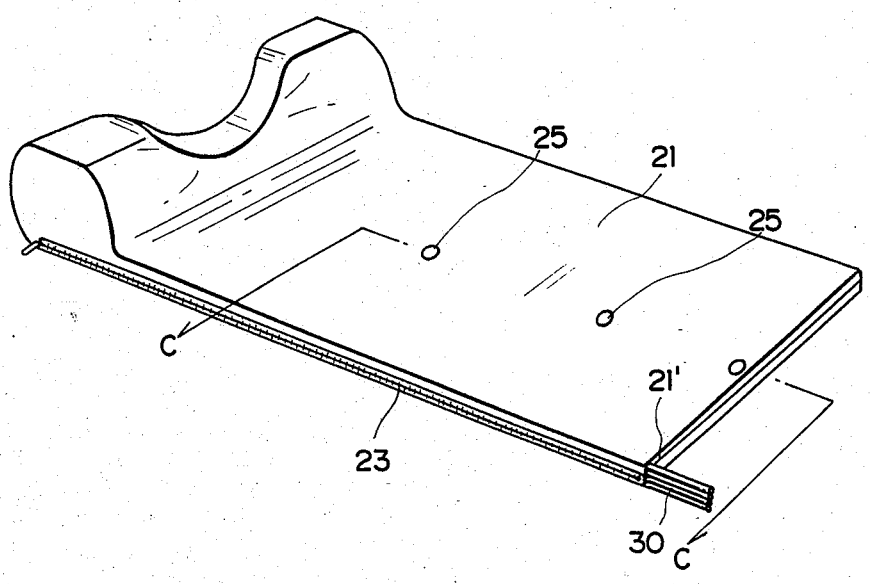
FIG. 5A is a perspective view showing the covering member applied over the mat body.
Figure 5B:
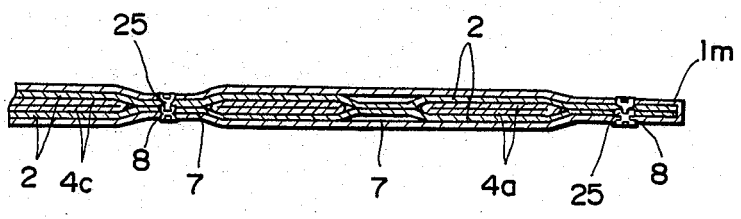
FIG. 5B is a longitudinally sectioned view taken along the line C—C of FIG. 5A.

FIG. 5 A shows a covering member 21 for the mat body 1. The covering 21 is in the bag form, and is made of a cloth material which is soft and agreeable to the touch, such as flannel. The covering 21 is applied to the mat body 1 in which the zone I of the shoulder massage portion 9 is constricted at the center by tying with the strap 22, and recevies the headrest member 10. The covering 21 is provided at one long side with a slide fastener 23. It is to be understood that the back side of the covering 21 may be formed of a napped cloth material.

A group of feed/discharge pipes 30 for compressed air are inserted through an opening 21'. A snap button 25 is inserted through the eyelet 8 formed in the space 7 of the mat body 1 to join together both sides of the covering 21 at a suitable position. The reason why this button is provided is to allow the covering 21 to follow repeated expansion and contraction of the mat body 1.

In what follows, the compressed air source will now be explained with reference to FIGS. 8 to 12 inclusive.

A pair of casings 28 and 29 receive therein an electromagnetic reciprocating compressor 25, a distributor 26 and a pressure regulator 27. A remote controller 68 is detachably mounted in an opening formed in the front portion of the casing 23. The structure of each part will be described in detail later. The compressed air source serves to guide compressed air discharged from the compressor 25 into the distributor 26, from whence the compressed air is successively distributed to eight (8) circuits. The compressed air is then fed into the associated air bags 4*a*–4*f*, 4*h* and 4*j* through eigth (8) feed/discharge pipes 30.

Figure 8:
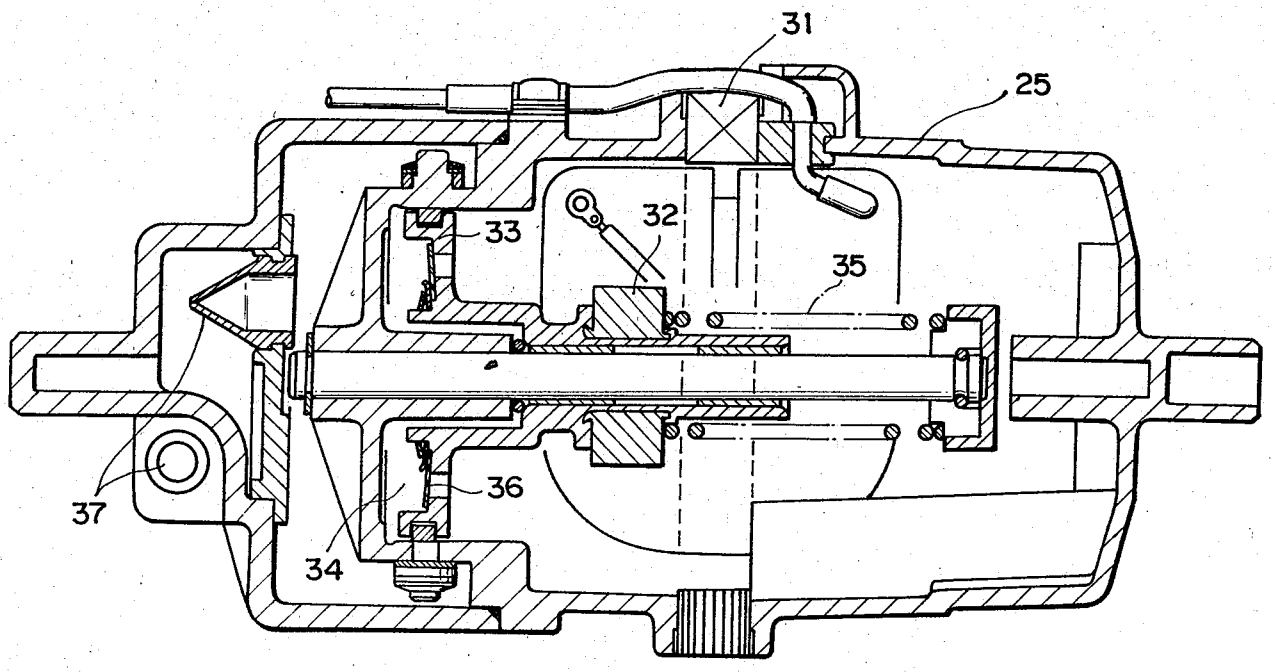
FIG. 8 is a longitudinally sectioned view of one embodiment of the compressor.

FIG. 8 is a sectional view showing one embodiment of the electromagnetic reciprocating compressor 21, which has an electromagnet 31 including the opposing poles, an armature 32 disposed on the center line between the poles for reciprocal movement, a piston 33 movable in unison with the armature 32, an air compression chamber 34 in which the piston 33 reciprocates, a compression spring 35 for retruning the armature 32 with the piston 33 to the original positions, and a suction port 36 for guiding air into the compression chamber 34. The suction port is provided with an one-way valve, and a discharge port 37 for guiding compressed air generated in the compression chamber into the distributor 26 and the pressure regulator 27. The discharge port is provided with an one-way valve. The electromagnet 31 attracts the armature 32 between the opposing poles by the positive half-cycle of an a.c. current. When the magnet 31 is demagnetized by the negative half-cycle of an a.c. current, the piston 33 advances together with the armature 32 under the action of the compression spring 35 to compress air within the compression chamber 34. A series of operations of suction, compression and discharge are repeated by reciprocal movement of the piston.

Figure 9A:
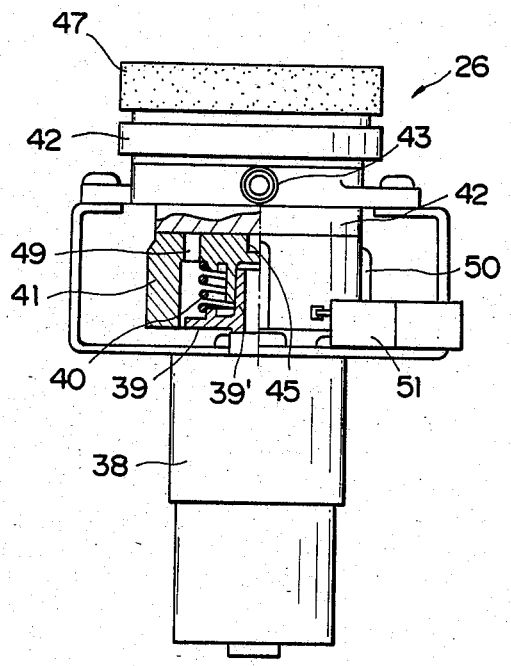
FIG. 9A is a side view, partly cut-away, of the distributor.
Figure 9B:
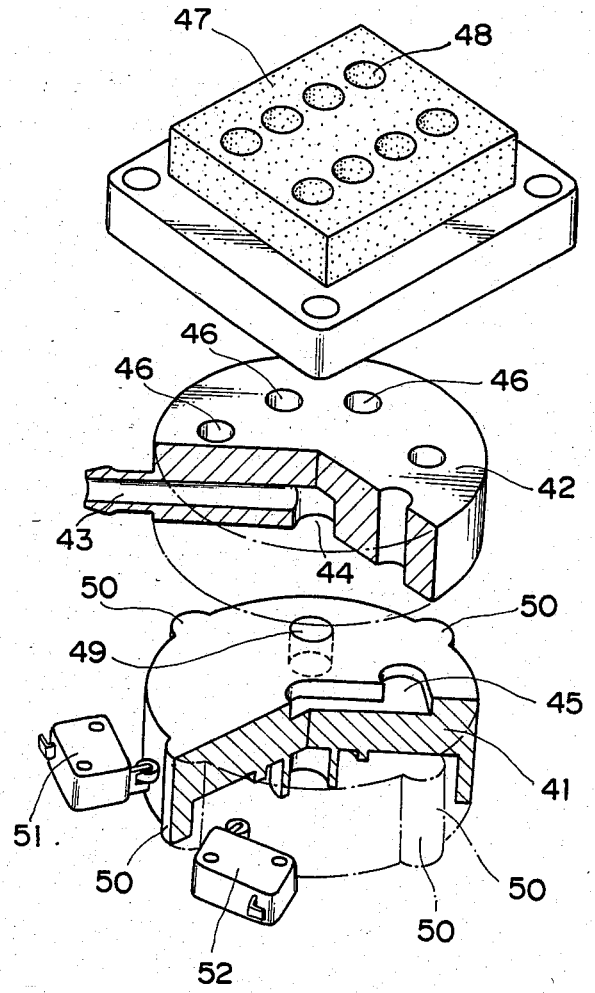
FIG. 9B is a perspective view showing that distributor with the rotary valve, the stationary valve and the socket being separated.

FIGS. 9A and 9B show one embodiment of the distributor 26, which consists essentially of a d.c. motor 38, the revolutions per minute of which is controllable by a variable resistor R1, a rotary valve member 41 which is engaged with a boss 39' of a rotation trasmitting member 39 fixed to the rotating shaft of the motor 38, and rotates therewith through a compression spring 40, and a stationary valve member 42 brought into plane contact with the upper surface of the rotary valve member 41. The stationary valve member 42 is provided with a suction pipe 43 extending through a part of the outer periphery thereof. The suction pipe 43 is provided in the inner end with a discharge port 44 which is open downwardly.

The rotary valve member 41 is formed in the upper surface with an air-guiding groove 45 which communicates at the central portion with the discharge port 44. The stationary valve member 42 is provided in the vicinity of the outer periphery with eight (8) vertical through-holes 46 at regular intervals, which communicate alternately with the air-guiding groove 45.

A socket 47 is fixed to the side of the casing 28. Two sets of four openings 48 for receiving the open ends of eight (8) feed/discharge pipes 30 are longitudinally drilled in the socket. The socket 47 is united with the stationary valve member 42, and the through-holes 46 separately communicate with the openings 48. A discharge hole 49 is vertically drilled through the rotary valve member 41. The discharge hole 49 is located at the position where it can communicate with any one of the through-holes 46 formed in the stationary valve member 42. However, when the air-guiding groove 45 is in communication with a certain one of the through-holes, the discharge hole 49 then communicates with the through-hole 46 located before said certain through-hole by two holes.

At least one projection 50 is formed on the outer surface of the rotary valve member 41, and limit switches 51 and 52 are arranged therearound with the projection 50 being disposed therebetween at the required intervals. During the rotation of the rotary valve member 41 the limit switches 51 and 52 are put in on and off states by engagement with the projection 50.

Figure 10:
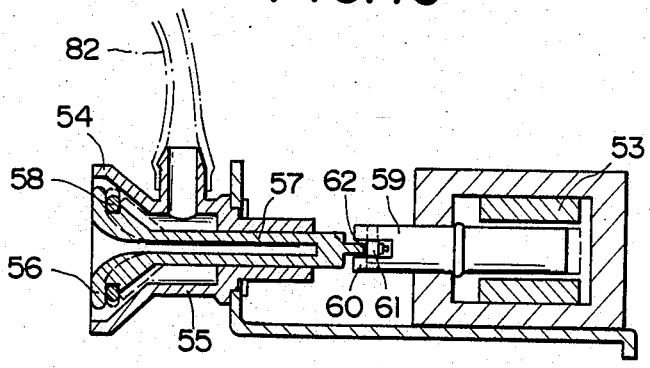
FIG. 10 is a longitudinally sectioned view of the pressure regulator.

FIG. 10 shows one embodiment of the pressure regulator 27, which uses a solenoid 53 as the driving source. The solenoid 53 includes an air inlet cylinder 55 having on the front side a valve seat 54 in the truncated cone form, and a slide valve 57 having a conical valve head at the extremity is inserted through the air inlet cylinder 55 for axially sliding movement. A ring packing 58 is fitted over the rear side of the valve head, and is engaged with the inner surface of the valve seat 54. A solenoid plunger 59 includes at the extremity a bifurcated portion 60, into which a connecting pin 61 is fixedly provided at right angles. A round hole 62, somewhat larger in diameter than the connecting pin 61, is drilled in the end of the slide valve 57. The slide valve 57 is connected to the solenoid plunger 58 by insertion of the connecting pin 61 into the hole 62. Thus, even when the slide valve 57 is not in axial agreement with the solenoid plunger 59, it is possible to achieve smooth operation of the slide valve 57 under the action of the solenoid 53.

Figure 11:
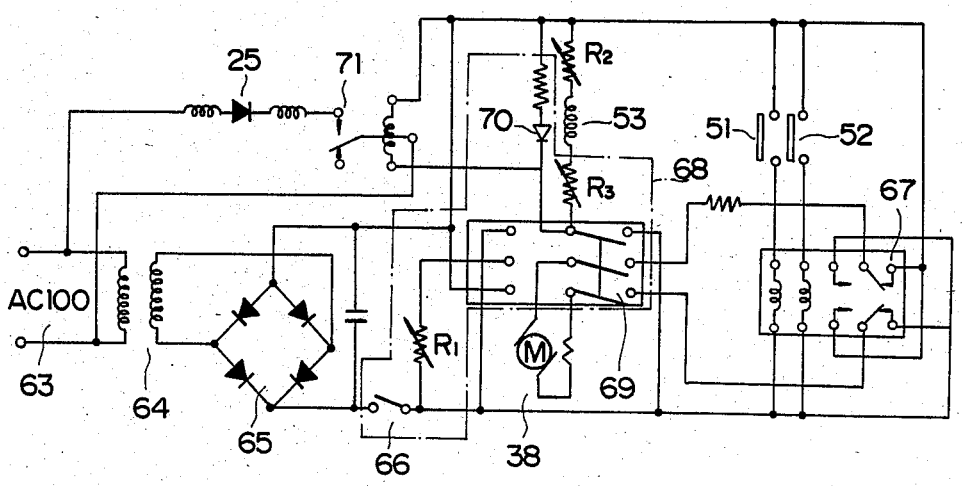
FIG. 11 is a diagram showing the control circuit.
Figure 12:
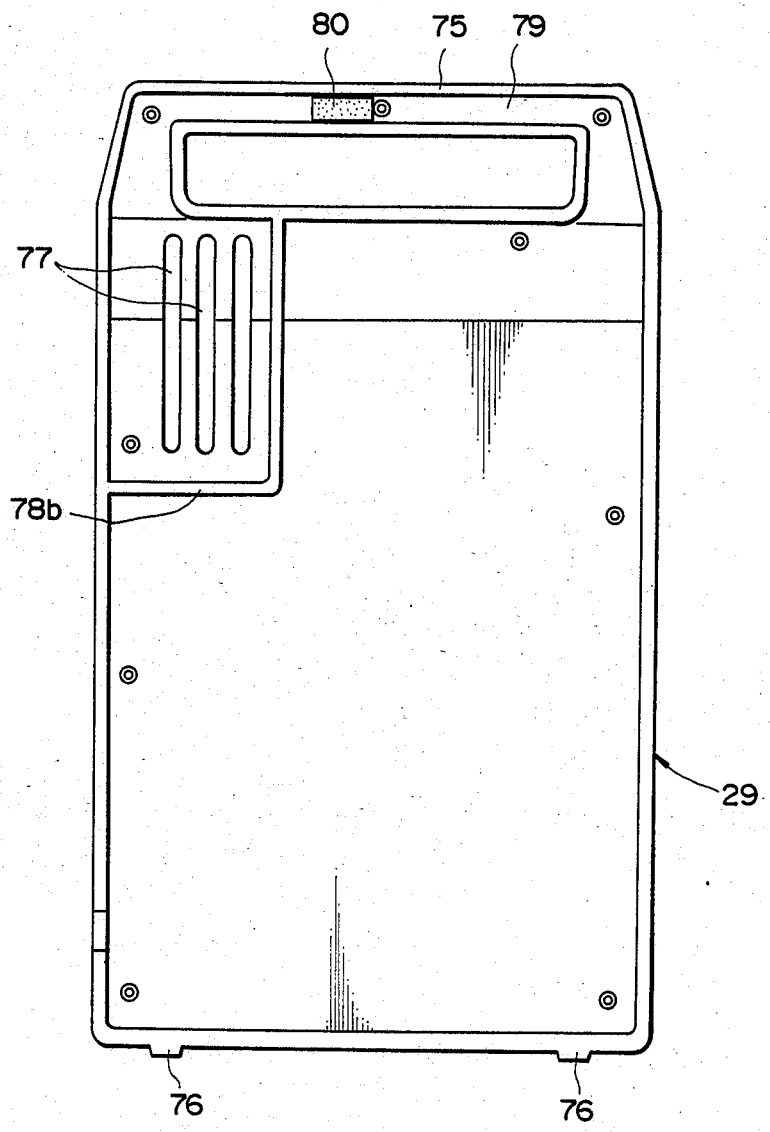
FIG. 12 is a plan view of the lower casing.

FIG. 11 shows one embodiment of an electric circuit for driving and controlling the compressor 25, the distributor 26 and the pressure regulator 27. A current from an a.c. current source for driving the compressor 25 is fed through a transformer 64 into a rectifier 65 for the conversion thereof to a d.c. current. Through a timer 66 and a keep relay 67, the d.c. cuurent is fed, on the one hand, into the limit switches 51 and 52 through the rotary valve member 41 and into the contact of that relay 67 and, on the other hand, into the remote controller 68.

The remote controller 68 is provided with a tripolar change-over switch 69, by which the current from the rectifier 65 is fed directly into the motor 38 for the distributor 26, or through the keep relay 67 into the motor 38. The remaining one pole of the change-over switch 69 serves to supply currents to a light-emitting diode 70 acting as a pilot lamp, resistors R2 and R3 for regulating the voltage applied upon the solenoid 53 of the pressure regulator 27, and a driving relay 71 for the compressor 25. It is to be noted that connection is made between the remote controller 68 and other controls received in the lower casing 29 by a spiral cord 72. Reference numeral 73 stands for a covering member for the controls.

The casings 28 and 29 include at the front portion hollow grip members 74 and 75 which are to overlap each other to define a single grip. The casings 28 and 29 also include at the back portion projections 76 and 76 which serve to keep them upright in a stable manner, when they are positioned upwardly within the grip.

The lower casing 29 is provided therein with a suction slit 77, around which a partition 78*b* is provided. The upper casing 28 is also provided with a similar partition 78*b* at a position opposite to the former partition. Thus, when the upper and lower casings 28 and 29 are closed together, the interiors of the casings 28 and 29 are isolated from a suction position by both partitions 78*a* and 78*b*, so that air sucked through the slit portion 77 is admitted into the casings through a passage 79 defined within the hollow grip, whereby vibratory noises resulting from the compressor 25 are prevented from leaking directly through the slit 77. An air filter 80 is provided in the passage 79 formed in the grip.

Figure 7:
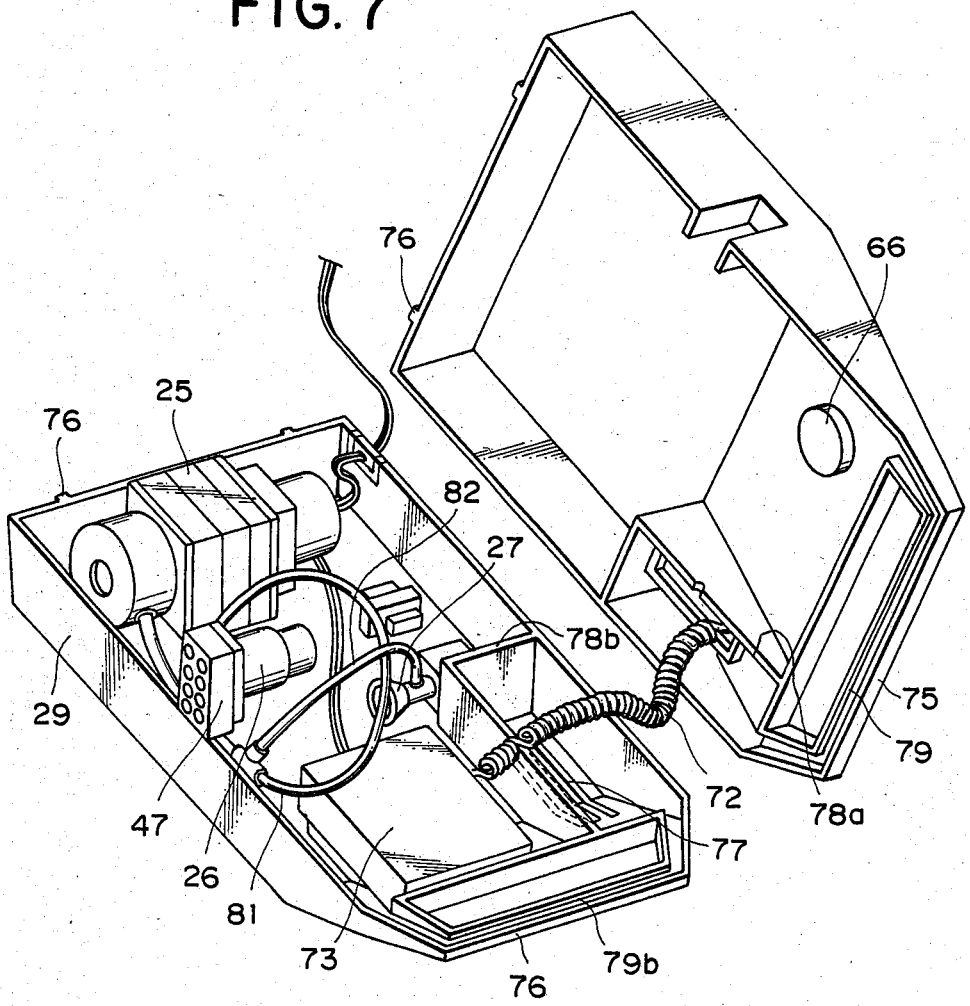
FIG. 7 is a perspective view showing the compressed air source with the upper casing being separated from the lower casing.

As will be understood from FIG. 7, an air conduit 81 is provided to make connection between the compressor 25 and the distributor 26, and includes a branch pipe 81 for guiding air into the pressure regulator 27.

The action of the present invention will now be explained with reference to the foregoing embodiment.

First, the zone I, not filled with air, of the mat body 1 is constricted at the center by tying with the straps 22 and 22, and the headrest member 10 is placed on the zone G, not filled with air. As shown in FIG. 3B, the shoulder massage portion 9 is then wound around the headrest member 10. Subsequently, the strap 20 is inserted into the eyelets 19*g* and 19*n* to join together the zones G and N, not filled with air. In this manner, the air chamber J is engaged with the front portion 12*a* of the headrest member 10, whilst the air chamber H is engaged with the back portion 12*b* thereof, whereby the headrest member 10 is fixedly maintained on the mat body 1. At this time, the zone I constricted by the straps 22 serves to maintain the concave surface 11 of the headrest member 10.

Figure 6A:
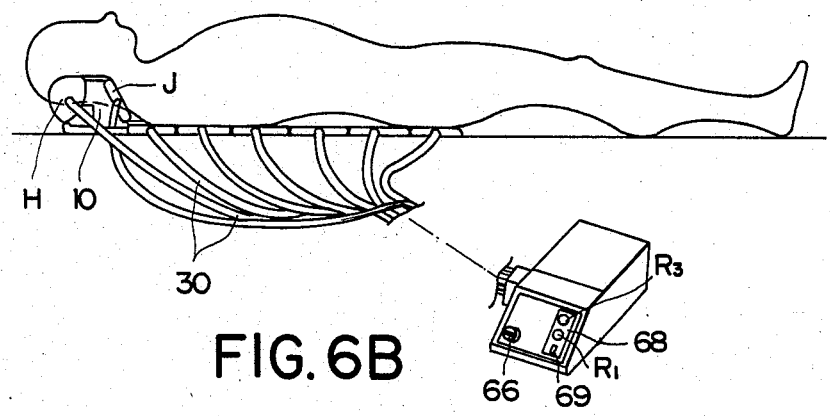
FIG. 6A is a side view of the headrest member, which is filled with air on the back side.
Figure 6B:
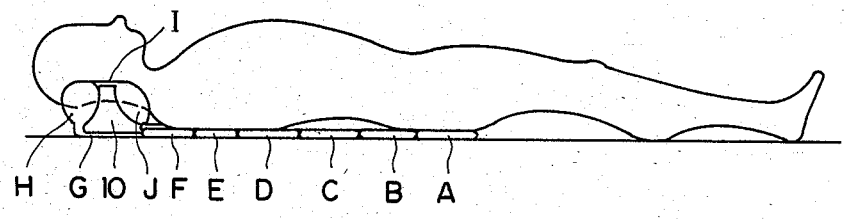
FIG. 6B is a side view of the headrest member, which is filled with air on the front and back sides.

After the headrest member 10 has been fixed to the mat body 1, the feed/discharge pipes 30 connected to the socket 47 of the compressed air source are connected with the respective air feed/discharge ports 17 and the air feed port 18 (provided with the check valve) formed in one side edge of the mat body, thereby to feed air into the air bags 4*a*–4*f*, 4*h* and 4*j* of the air chambers A-F, H and J for each the predetermined period of time. In this state, the mat body 1 is accommodated in the covering member 21, and the open edge thereof is zipped up with the slide fastener 23, as illustrated in FIG. 5A. The snap buttons 25 inserted into the eyelets 8 formed in the central portion of the mat body 1 prevent disengagement of the mat body 1 out of the covering member 21 during pneumatic massage. As individual lies at a full length on the thus prepared mat arrangement with the neck region being placed on the concave surface 11 of the headrest member 10, as shown in FIGS. 6A and 6B. Thereupon, the compressed air source is driven.

The compressor 25 forming part of the compressed air source is actuated by setting the timer 66 and manipulating the change-over switch 69 for the remote controller 68. Simultaneously with change-over of the switch 69 to the continuous operation mode, the d.c. current flows from the rectifier 65 to the motor 38 of the distributor 25 by way of the change-over switch 69, whereby the motor is continuously rotated in the same direction. The compressed air is fed from the compressor 25 to the suction pipe 43 of the stationary valve member 42 of the distributor 26 by way of conduits 81 and 82, and flows into the air-guiding groove 45 formed in the upper surface of the rotary valve 41 through the discharge port 44. By rotation of the motor 38, the rotary valve 41 permits the air-guiding groove 45 to be successively put in operative association with the through-holes 46 formed in the stationary valve member 42. A part of air passing through each through-hole 46 in the stationary valve 42 flows toward the pressure regulator 27 by way of the branch pipe 82, and another part of air is supplied into associated one of all the air bags 4*a*–4*f*, 4*h* and 4*j* provided to the air chambers of the mat body 1 through the associated one of the feed/discharge pipes 30 inserted into the socket 47.

It is to be noted that, in order to prevent a pneumatic pressure exceeding the blood pressure of an individual from being applied thereon, the pressure regulator 27 functions such that the maximum voltage impressed upon the solenoid 53 is previously fixed by the variable resistor R2, and voltage can externally be controlled by the aforesaid variable resistor R3. In consequence the electromagnetic force of the solenoid 53 is non-stepwise adjusted to vary the attraction of the solenoid plunger 59 for the regulation of the degree of attraction of the slide valve 57 connected to the solenoid plunger 59. If the resistance values of the variable resistors R2 and R3 are reduced to increase the attraction of the plunger 59, the packing 58 mounted on the valve head 56 of the slide valve 57 is then firmly engaged with the valve seat 54 to prevent release of the air from the said valve seat, said air being guided into the air inlet cylinder 55 through the conduit 82. If the attraction of that plunger is decreased, there is then no or little engagement of the packing 58 with the valve seat 54. Thus a part of the air admitted into the air inlet cylinder 55 through the conduit 82 is discharged from a gap defined between the valve seat 54 and the valve head 56. Consequently, when the electromagnetic reciprocation type compressor 25 illustrated in the foregoing embodiment is used, it is very unlikely that the entire discharge pressure of that compressor may be applied to all the air bags 4*a*–4*f*, 4*h* and 4*i*, and when other type compressor is employed, there is no possibility that any abnormally high pressure may be impressed upon those air bags.

Successive feeding of compressed air causes succeessive expansion of the air bags 4*a*–4*f*, 4*h* and 4*j*. When the compressed air is admitted into a certain air bag for the predetermined period of time, the rotation of the rotary valve 41 permits the air-guiding groove 45 to disengage the associated through-hole 46 in the stationary valve 42, thereby to discontinue the supply of compressed air. While the motor 38 continues to rotate, subsequent rotation of the rotary valve 41 causes that the preceding through-hole of said certain through-hole 46 communicates with the discharge opening 49, through which the compressed air is discharged to contract a certain air bag within the mat body 1. In this manner the individual air bags 4*a*–4*f*, 4*h* and 4*j* are repeatedly subjected to expansion and contraction, whereby the mat body 1 is as a whole subjected to repeated rhythmic wave motion, thus giving rhythmic massage to the waist, back, shoulder and head regions of the body lying on the mat body 1. In particular, massaging the shoulder, neck and head regions is achieved in the manner mentioned below.

The headrest member 10 is enclosed within the shoulder massage portion 9 of the mat body 1. When the air chambers J and H located over the front and back portions of the headrest 10 are expanded by expansion of the associated air bags 4*j* and 4*h* enclosed therein, expansion of the air chamber H first takes place to apply pressure to the back side of the headrest 10. Then, the air chamber J expands. While bearing the occipital region, the thus expanded air chamber H provides massage to the shoulder, neck and occipital regions. In the meantime, the chamber H prevents rearward tilting of the headrest 10, and constantly receives a reaction from the air chamber J now expanded. Since an amount of compressed air is introduced from the feed opening 18 (equipped with the check valve) into the air bag 4*h* for bearing the back side of the headrest 10, the air chamber H continues to expand, as illustrated in FIG. 6A, even when feeding of compressed air into the bag 4*h* is stopped. This serves to bear the neck and occipital regions and provide effective and constant massage to the neck and shoulder regions, while preventing any rearward tilting of the headrest 10, without wasteful discharge of air.

After the completion of massage of the shoulder, neck and occipital regions with the shoulder massage portion 9, the distributor 27 makes preparations to allow compressed air to be fed into the air bag 1a of the mat body 1 for expansion.

In this manner the foregoing operations are repeated.

While reference has been made to massage using the entire surface of the mat body 1, reference will then be made to another embodiment of massage wherein local massage is applied to the desired region.

For local massage, the tripolar change-over switch 69 of the remote controller 68 is changed-over to the local operation mode. while the compressor 25 continues to drive, a current is fed to the motor 38 of the distributor 26 via the keep relay 57. Normal rotation of the motor 38 causes the projection 50 formed on the outer surface of the rotary valve 41 to actuate the limit switch 51. When the contact is closed, change-over of the contact of the keep relay 67 takes place, so that the d.c. current fed to the motor 38 changes in polarity, thereby to cause the opposite rotation of the motor 38. The motor 38 now rotating in the opposite direction causes the contact of the limit switch 52 to be closed by the projection 50, and the keep relay 67 is change-over to the original state. This causes the motor 38 to rotate again in the normal direction. This causes repeated rotation of the rotary valve 41 in the opposite directions. In the meantime, localized massage is repeatedly applied to the shoulder, neck and occipital regions by repeatedly feeding compresed air into certain two air bags, for instance, 4*h* and 4*j*, by change-over of the contact of the keep relay 57.

According to the arrangement as described with reference to the drawings and defined in the appended claim, when compressed air is fed to the front and back surfaces of the headrest member 10 enclosed within the end of the mat body, the air chamber located on the front side of the member 10 is subjected to repeated expansion and contraction, while receiving a reaction from the air chamber located on the back side thereof, whereby effective pneumatic massage is applied to the waist, back, shoulder, neck and occipital regions. In addition, since the front side of the headrest member for applying pressure to the shoulder region is tied together at the end of the air chamber J, that air chamber buldges largely at both ends fowardly, more specifically upwardly, upon receiving a reaction from the headrest member 10, thereby to apply massage to the shoulder region. Either the continued wave motion of the mat body over the entire surface or the localized motion of the mat body is selected by preference by controlling the compression air source for successively feeding compressed air into the mat body. The use of the pressure regulator also produces a stable massage effect with the most preferred pressure.

The invention being thus described, it will be obvious that the same may be varied in many ways. Such variations are not to be regarded as a departure from the spirit and scope of the invention, and all such modifications as would be obvious to one skilled in the art are intedned to be included within the scope of the following claim.

We claim:

1. A pneumatic massaging apparatus comprising:

a headrest member provided with a concave surface in its upper surface, said concave surface being symmetrical with respect to a central cross-sectional line of said headrest member;

a substantially rectangular-shaped mat body provided with a plurality of air chambers for massaging a user's waist and back regions and a massaging portion for massaging a user's shoulder, neck and occipital regions, each of said air chambers is sequentially disposed side by side with each other and extends in a width direction of said mat body to the extent that a width of each of said air chambers is longer than that of said user resting on said mat body with his face upward and is provided with a constricted portion in its middle portion in said width direction;

said massaging portion for massaging said user's shoulder, neck and occipital regions being constructed of, front and back air chambers covering front and back portions of said headrest member respectively, a non-air-chamber zone interposed between said front and back air chambers and covering said upper surface of said headrest member, and non-air-chamber zones having fixing means for fixing said headrest member to said mat body;

a compressed air source connected to said plurality of said air chambers of said mat body to sequentially individually supply and discharge the compressed air to and from said air chambers or selectively to supply and discharge the compressed air to and from specified ones of said air chambers only;

a distributing mechanism for distributing compressed air from said compressed air source and including a compressed air supplying/discharging mechanism provided with a rotary valve reversibly rotated by a motor;

a plurality of switches operatively positioned around said rotary valve for changing a rotational direction of said motor;

a keep relay and a keeper switch for controlling an electric power circuit for said keep relay; and an electric power source circuit for said motor of said compressed air distributor;

said keep relay including a switch for maintaining a normal rotation of said motor, said switch being alternatively switched on/off by a switching action of said plurality of switches and a switch for a normal/reverse rotation of said motor;

whereby by operating said keeper switch said mat body performs as a whole a wave motion by sequential feeding and discharging of the compressed air into and from entire portions of said mat body, or said mat body performs a local wave motion by repeated feeding and discharging of the compressed air into and from a certain portion of said mat body.

2. A pneumatic massaging apparatus according to claim 1, wherein said rectangular-shaped mat is divided into eight air chambers.

3. A pneumatic massaging apparatus according to claim 2, wherein said distributor includes eight passageways for controlling the supply of compressed air to said eight air chambers.

4. A pneumatic massaging apparatus according to claim 3, wherein said distributor includes a movable valve member operatively connected to said motor for selectively supplying compressed air to said eight passageways.

* * * * *